United States Patent [19]

Graham

[11] 4,418,630

[45] Dec. 6, 1983

[54] BELT GUARD LOCK

[75] Inventor: Richard P. Graham, Westfield, N.J.

[73] Assignee: The Singer Company, Stamford, Conn.

[21] Appl. No.: 241,329

[22] Filed: Mar. 6, 1981

[51] Int. Cl.[3] ..... D05B 83/00

[52] U.S. Cl. ..... 112/261

[58] Field of Search ..... 112/258, 261; 474/144

[56] References Cited

U.S. PATENT DOCUMENTS

| | | | |
|---|---|---|---|
| 461,497 | 10/1891 | Dobeck | 474/144 X |
| 947,651 | 1/1910 | Schreiber | 112/261 |
| 1,285,725 | 11/1918 | Judelshon | 474/144 |
| 1,302,196 | 4/1919 | Migliore | 112/261 X |
| 1,439,552 | 12/1922 | Johnson | 70/232 X |
| 1,444,379 | 2/1923 | Jones | 70/232 X |
| 2,168,501 | 8/1939 | Stoyanowski | 474/144 X |
| 2,486,528 | 11/1949 | Hope | 112/258 |
| 4,313,321 | 2/1982 | Wasser | 70/232 X |

*Primary Examiner*—Wm. Carter Reynolds

*Attorney, Agent, or Firm*—Edward P. Schmidt; Robert E. Smith; Edward L. Bell

[57] ABSTRACT

A belt guard lock for a belt guard pivotable on a pivot shaft affixed thereto and supported in a pivot frame attached to the sewing machine table, which guard lock effectively prevents pivoting of the belt guard by a sewing machine operator but may be readily defeated by a suitably authorized maintenance man. The guard lock fits about the pivot shaft affixed to the belt guard and remains therewith, so as to be available for use in any machine to which it is attached. The guard lock is implemented by a collar slidable on the pivot shaft and having a flange thereof which extends between the lower edge of the belt guard and the sewing machine table to prevent rotation of the belt guard. The belt guard lock may be rendered ineffective by loosening a special set screw inpinging on the pivot shaft and sliding along the pivot shaft to a position where the flange thereof is aligned with a slot in the belt guard to accommodate the flange during pivoting motion of the guard.

3 Claims, 4 Drawing Figures

BELT GUARD LOCK

BACKGROUND OF THE INVENTION

This invention is in the field of sewing machines; more particularly, it is concerned with a device which prevents removal of a belt guard without some initial deliberate act designed to alert a person to the potential for bodily harm and deter removal by unauthorized persons.

Belt guards have been used with sewing machines for many years for the purpose of protecting a sewing machine operator and other persons from injury due to entrainment of clothing or physical entanglement with moving parts of the sewing machine. An early form of sewing machine belt guard is shown in the U.S. Pat. No. 947,651 issued on Jan. 25, 1910 to Schreiber and discloses a belt guard which covers the handwheel end of a sewing machine in such a fashion as to permit limited access to the handwheel for rotation thereof, but cover a belt and pulley portion thereof to protect an operator against the dangers recited above. The belt guard disclosed in the above patent is fastened to the sewing machine bed with a hook which could be removed to swing the belt guard away for access to the belt, but the belt guard is available for protection during operation of the sewing machine when the operator's attention was diverted elsewhere.

A more recent belt guard is disclosed in the U.S. Pat. No. 2,790,407, issued on Apr. 30, 1957 to Andrés, which discloses a belt guard pivotably carried by a fixture attached to a sewing machine table, which belt guard was suitable for use with a variety of sewing machines which might be installed in that specific table. In a most recent prior art belt guard, predecessor to this invention, the belt guard itself is provided with a pivot rod extending between ears thereof, the pivot rod being slabbed on opposite sides thereof on the extremities adjacent the ears of the guard. A pivot frame was provided with lugs upstanding adjacent the ears of the belt guard, the lugs having slots therein extending to apertures which fit about the pivot rod. In operation the belt guard could be rotated until the slabbed portions of the pivot rod align with the slots in the pivot frame permitting access of the pivot rod to the apertures in the upstanding lugs. Thus, the belt guard could be removed rather readily for service by swinging back the belt guard until the slabbed surfaces were aligned with the slots in the pivot frame and removed therefrom. Unfortunately, the ease of removal of the belt guard contributed to frequent operation of the sewing machine without the belt guard due to removal thereof by the sewing machine operator.

What is required is some means for preventing ready removal of the belt guard from the sewing machine by a sewing machine operator, but retain this ease of removal feature for a maintenance or repair person.

SUMMARY OF THE INVENTION

The above desired end is achieved by the addition of a collar encircling the pivot rod of the above-mentioned most recent prior art belt guard, the collar having a flange extending between the belt guard and the table top so as to prevent rotation of the belt guard on the pivot rod. The position of the collar may be locked by a special socket screw since a special wrench is required for manipulation of the screw, which special wrench is not generally available to a sewing machine operator. A slot is provided on the end of the belt guard adjacent the upstanding lug of the pivot frame, the slot being of a sufficient width to accommodate the flange attached to the collar. By loosening of the special socket screw and positioning of the collar and flange adjacent the upstanding lug of the pivot frame, the belt guard may be rotated to where the slabbed sides of the pivot rod align with the slots in the pivot frame to permit removal therefrom. Removal of the belt guard from the pivot frame brings with it the collar and flange thereby ensuring that a belt guard reinserted on the sewing machine would be provided with its locking device. Retrofitting of sewing machines having a belt guard without a locking device is accomplished rather readily by installing a belt guard lock on the pivot rod thereof.

DESCRIPTION OF THE DRAWINGS

The novel features which are considered as characteristic for the invention are set forth in particular in the appended claims. The invention itself, however, both as to its construction and its method of operation, together with additional objects and advantages thereof will best be understood from the following description of a specific embodiment when read in conjunction with the accompanying drawings in which:

Referring now to FIG. 1 there is shown a rear perspective view of a sewing machine 10 one end of which is covered by a belt guard 12 for safety of a sewing machine operator from the belt 17 extending about the handwheel pulley 15 of the sewing machine down to the sewing machine motor 11 supported below a sewing table 14. The belt guard 12 is formed with ears 16 on both sides of the rear extremity thereof, which ears support a pivot rod 18 extending therebetween (see also FIG. 2). The pivot rod 18 is fashioned with slotted end 19 to permit rotation of the pivot rod to a selected position which may be locked by means of a set screw 20 extending through one ear (see FIG. 3). The pivot rod 18 is further fashioned with slabbed sides 21 180° apart on the rod and spaced close to the ends thereof for a purpose which will be described below.

Figure 1:
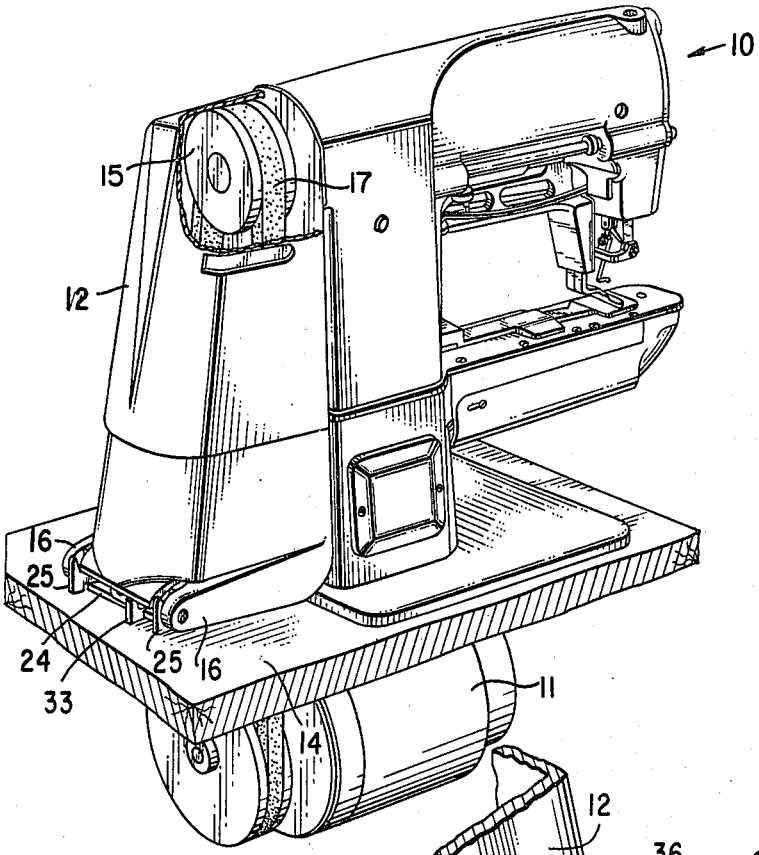
FIG. 1 is rear perspective view partially broken away of the sewing machine in which the invention may be utilized.
Figure 4:
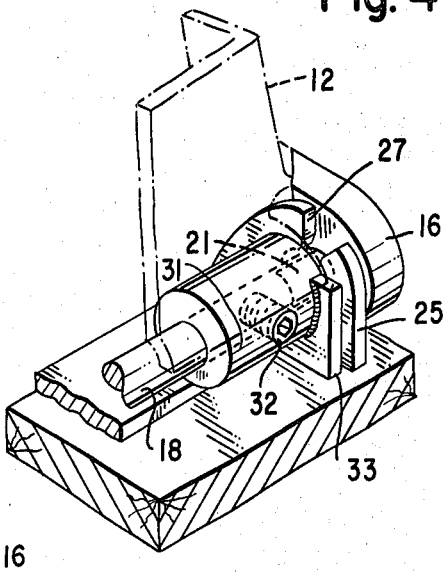
FIG. 4 is a perspective view of a portion of a belt guard shown in FIG. 3 indicating how the belt guard lock may be positioned to permit separation of the belt guard from the sewing machine.

The sewing table 14 supports thereon a pivot frame 24, which pivot frame may be fashioned of sheet metal. The pivot frame 24 includes two upstanding lugs 25 on the ends thereof, which upstanding lugs include aligned apertures 26 extending therethrough. Slots 27 in the upstanding lugs 25 provide access to the apertures 26, the slots being of such a width as to accommodate the slabbed sides 21 of the pivot rod 18 which are spaced apart so as to be aligned with the upstanding lugs. Thus, the pivot rod 18 is rotated in the ears 16 of the belt guard 12 by means of the slotted end 19 so that the slabbed sides 21 of the pivot rod are not aligned with the slots 27 in the upstanding lugs 25 when the belt guard 12 is positioned in a first position as shown in FIG. 1. However, if the belt guard 12 were to be rotated in the pivot frame 24 on the pivot rod 18, the slabbed sides 21 of the pivot rod would be aligned with the slots 27 so that the belt guard could be withdrawn from the pivot frame.

Figure 2:
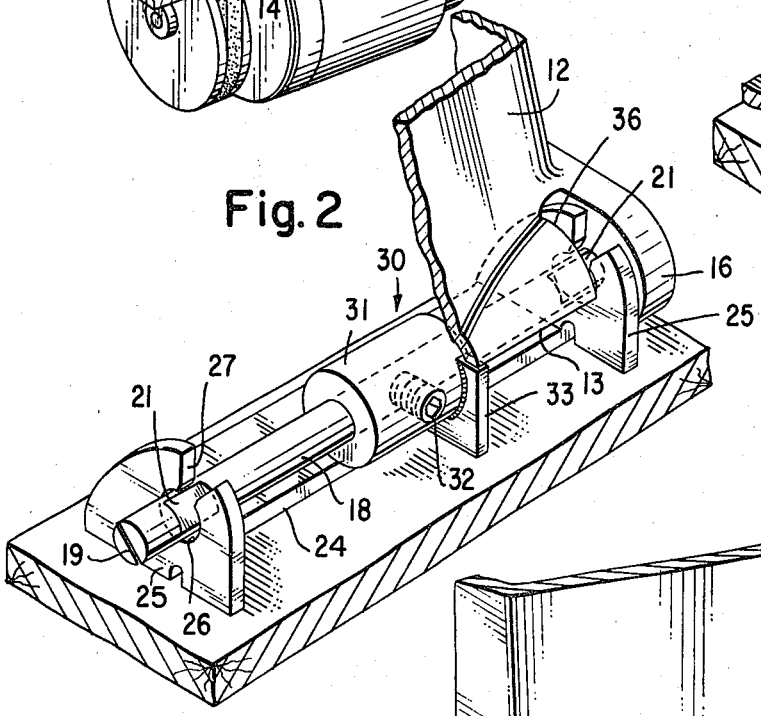
FIG. 2 is a partially broken away perspective view of a portion of the belt guard and pivot frame indicating how the belt guard is mounted to the sewing machine.

However, in order to ensure that a sewing machine operator will not remove the belt guard 12 and possibly defeat its purpose by operating the sewing machine 10 without the belt guard in position, a means was necessary to make it impossible for a sewing machine operator to remove the belt guard but not appreciably increase the difficulty of removal thereof from the sewing machine 10 by maintenance personnel. In order to accomplish this objective a lock 30 is provided as is shown in FIG. 2, which lock includes a collar 31 encircling the pivot rod 18. A set screw 32 is threadedly carried by the collar 31, the set screw bearing against the pivot rod so as to lock the collar in a selected position. Ideally, a type of socket set screw is selected since a special tool is required for removal thereof, a tool not commonplace or normally available to a sewing machine operator. Alternatively, special heads may be provided for the set screw 32 which would permit loosening of the set screw only by specially provided tools. On one end of the collar 31 there is situated a flange 33 which extends out from the collar between the sewing table 14 and the lower edge 13 of the belt guard which is spaced from the sewing table when the belt guard 12 is in the first position. Thus, the lock 30 by interposing the flange 33 between the belt guard 12 and the upward facing surface of the sewing table 14 prevents rotation of the belt guard.

Figure 3:
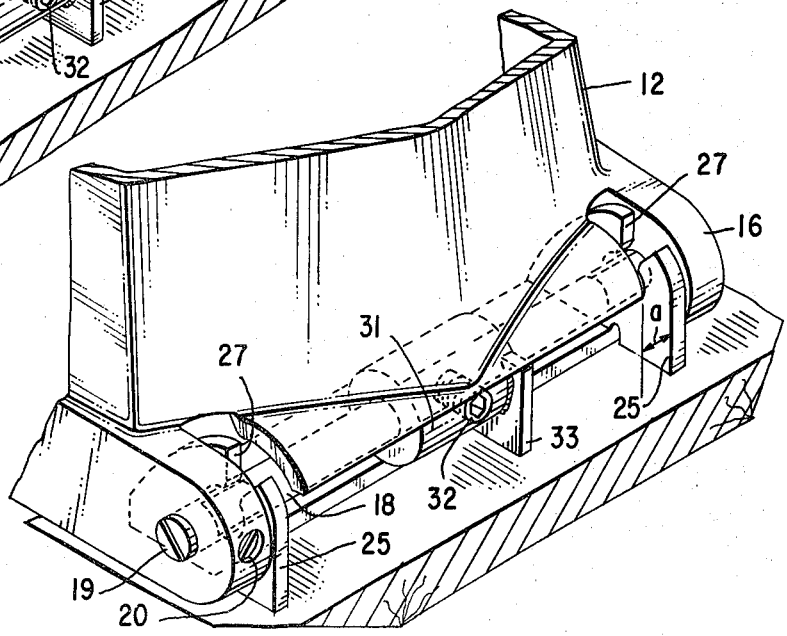
FIG. 3 is a perspective view similar to FIG. 2 showing the belt guard locked into position with rotation thereof blocked.

Adjacent one ear 16 of the belt guard 12 an extra wide slot 36 may be provided to accommodate not only the upstanding lug 25 of the pivot frame 24, but also the flange 33 of the lock 30. Thus by loosening the set screw 32 fixing the position of the lock 30 in the central portion of the pivot rod 18, the lock 30 may be moved so that the flange 33 is accommodated in the space as (see FIG. 3) provided by the extra wide slot 36. With the lock 30 thus positioned, the belt guard 12 may be rotated to a second position where the lower edge 13 is adjacent the sewing table 14 and the slabbed sides 21 of the pivot rod 18 are aligned with the slots 27 in the pivot frame, so as to permit removal of the belt guard from the sewing machine 10. The belt guard 12 may be as readily reinserted in position on the sewing machine 10 and the lock 30 may be positioned as shown in FIG. 3 and retained in this position by tightening of the set screw 32 to prevent further removal of the belt guard 12 by any unauthorized person.

What is claimed is:

1. A belt guard for a sewing machine adopted for support in a sewing table having an upward facing surface, said sewing machine having a pulley supported at an end thereof, said sewing table supporting a drive motor therein, said drive motor being connected to said sewing machine pulley by at least one drive belt, guard means for preventing in a first position access to said pulley and said drive belt connection, means supported by said table for selectively pivotably supporting said guard in said first position for preventing an access to said drive belt connection of said sewing machine and in a second position for providing access to said drive belt connection, said supporting means being implemented by a pivot shaft affixed to said guard means and a pivot frame affixed to said sewing table, said pivot frame having an aperture for receiving said pivot shaft, said guard means having a lower edge spaced from said table surface in said first position and adjacent said table surface in said second position, wherein the improvement comprises:

means carried by said belt guard for selectively preventing and permitting rotation of said belt guard from said first position to said second position, said preventing means further comprising a collar slidable on said pivot shaft, a flange affixed to said collar and extending in said first position between said table surface and said guard means edge whereby said guard means is prevented from rotation about said pivot shaft to said second position;

means for retaining said preventing means in an effective rotation preventing position against movement by tools available to a sewing machine operator.

2. A belt guard as claimed in claim 1 wherein said guard means is further fashioned with a slot in said lower edge for accommodating said flange of said preventing means, whereby said collar is slidable on said pivot shaft to a position with said flange adjacent said slot so that said guard means may be rotated from said first position to said second position.

3. A belt guard as claimed in claim 2 wherein said retaining means is implemented by a screw threadedly carried by said collar and impinging on said pivot shaft, said screw having a socket in the outer end thereof for receiving a special turning tool.

* * * * *